US005374335A

United States Patent [19]

Lindgren et al.

[11] Patent Number: 5,374,335

[45] Date of Patent: Dec. 20, 1994

[54] SIZED PAPER, PROCESS FOR PRODUCING SAME AND USE THEREOF

[75] Inventors: Erik Lindgren, Bohus; Ulf Carlson, Billdal; Lennart Nilsson, Kungälv, all of Sweden

[73] Assignee: Eka Nobel AB, Bohus, Sweden

[21] Appl. No.: 144,247

[22] Filed: Nov. 1, 1993

Related U.S. Application Data

[63] Continuation of Ser. No. 967,515, Oct. 28, 1992, abandoned.

[30] Foreign Application Priority Data

Oct. 28, 1991 [SE] Sweden ..... 9103140

[51] Int. Cl.[5] ..... D21H 21/16

[52] U.S. Cl. ..... 162/158; 162/179; 162/181.6

[58] Field of Search ..... 162/158, 181.1, 181.6, 162/179

[56] References Cited

U.S. PATENT DOCUMENTS

| | | | |
|---|---|---|---|
| 2,581,186 | 1/1952 | Green | 162/181.6 |
| 3,266,973 | 8/1966 | Crowley | 162/181.6 |
| 3,694,202 | 9/1972 | Sawyer | 162/181.6 |

FOREIGN PATENT DOCUMENTS

| | | |
|---|---|---|
| 34970/89 | 11/1989 | Australia . |
| 0185068 | 6/1986 | European Pat. Off. . |
| 678636 | 10/1991 | Switzerland . |
| 2014970 | 9/1979 | United Kingdom . |
| WO89/08741 | 9/1989 | WIPO . |

OTHER PUBLICATIONS

Donald W. Breck, "Zeolite Molecular Sieves", Structure, Chemistry, and Use, J. Wiley & Sons, Jul. 1973.

Chem. Abstracts, 93:131113t, "Absorbent Paper", Gifu Prefecture Japan Kokai Tokkyo Kohno 80 62,299.

H. van Bekkum (Editors), "Introduction to Zeolite Science and Practice", Studies in Surface Science and Catalysis, vol. 58, 1991.

Peter A. Jacobs et al, "Synthesis of High-Silica Aluminosilicate Zeolites", Studies in Surface Science and Catalysis,, Elsevier Science Publishers B.V., vol. 33, 1987.

*Primary Examiner*—Peter Chin

*Attorney, Agent, or Firm*—Burns, Doane, Swecker & Mathis

[57] ABSTRACT

The present invention relates to a sized paper containing a hydrophobic zeolite. Suitably, the sized paper is fine paper, kraft liner or paperboard. In paperboard intended for solid or liquid foodstuffs, tobacco or medicines, use is also made of the capacity of the zeolite to reduce, by adsorption, the problem of transfer from the package to its content of substances causing undesirable taste or hazardous substances. The present invention also relates to a method for production of the sized paper by forming and dewatering a suspension of lignocellulose-containing fibres, where the dewatering is carried out in the presence of a hydrophobic zeolite. Due to the inert nature of the zeolite, it can be used in papermaking within a very broad pH range. The present invention also relates to the use of a hydrophobic zeolite for the production of sized paper as well as use of the thus-sized paper in packaging material.

18 Claims, No Drawings

SIZED PAPER, PROCESS FOR PRODUCING SAME AND USE THEREOF

This application is a continuation of U.S. application Ser. No. 07/967,515, filed Oct. 28, 1992, now abandoned.

The present invention relates to a sized paper, where the sizing effect is achieved by the paper containing a hydrophobic zeolite. The zeolite particles reduce the penetration of liquid into the ready-dried paper, an effect which is enhanced if the paper also contains a conventional sizing agent. Suitably, the sized paper is fine paper, kraft liner or paperboard aimed for solid or liquid foodstuffs, tobacco or medicines. In food board, use is also made of the capacity of the zeolite to adsorb chemical substances. This considerably reduces the problem of transfer from the package to the foodstuff contained therein of substances causing undesirable taste or hazardous substances. Furthermore, the invention concerns a method for production of the sized paper by forming and dewatering a suspension of lignocellulose-containing fibers, where the dewatering is carried out in the presence of a hydrophobic zeolite. Owing to its crystalline and consequently inert nature, the zeolite can be used in papermaking within a much broader pH range than is possible with previously known sizing agents. The instantaneous sizing effect of the zeolite is utilized in the production of fine paper, thereby facilitating coating operations and size press applications.

BACKGROUND OF THE INVENTION

Normally, paper is made up of lignocellulose-containing fibers bound to each other by hydrogen bonds. To give the finished paper certain desirable properties, the paper often contains specific paper chemicals, so-called function chemicals, for instance sizing agents, dry strength agents and wet strength agents. In the production of paper, also process chemicals are often used to improve production efficiency. Examples of such chemicals are retention agents, dewatering agents, defoamers and slime controlling agents.

Paper is primarily produced according to the wet process, in which a suspension of lignocellulose-containing fibers, water and, usually, one or more paper chemicals are dewatered on a water-permeable cloth (wire), thereby forming a fiber web or sheet which is pressed and dried into finished paper.

Many types of paper come into contact with liquids, primarily aqueous solutions or water vapour. Since the fibers have a strong attraction for water, i.e. they are hydrophilic, they will absorb water, which weakens the paper. This effect can be counteracted by coating the fibers with a water-repellent, i.e. hydrophobic, substance which reduces the possibility of penetration of liquid into the ready-dried web or sheet. For this purpose, use has previously been made of e.g. tall oil rosin from the sulphate process, paraffin wax dispersions, sodium stearate and cellulose-reactive sizing agents. In the production of paper, the hydrophobic substances are usually introduced by addition to the suspension of fibers and water (the stock), so-called stock sizing. Examples of paper which is sized includes liquid carton board, fine paper and kraft liner.

Japanese patent specification JP 62299/80 discloses paper containing zeolites. According to the Japanese specification, the paper contains a hydrophilic zeolite, mordenite, which increases the water-absorbing capacity of the paper, i.e. the opposite to what is desirable with a sizing agent.

Swiss patent specification CH 678636 discloses sizing of paper and paperboard by adding a sizing agent comprising a natural or synthetic resin in combination with an inorganic matrix containing aluminium and silicon. The insoluble inorganic matrix is suitably a natural or synthetic zeolite. The zeolites mentioned in this specification are either entirely hydrophilic or can be hydrophilic or hydrophobic depending on the pretreatment they have been subjected to. There is no information that the zeolites should be strongly hydrophobic since the aim of the zeolites mentioned in CH 678636 is to improve the retention of the sizing agent and not to act as sizing agents themselves.

Further, it is known to use natural zeolites as fillers in papermaking. Such natural zeolites are hydrophilic by being rich in aluminium as well as having a residual butanol content of 1.0, or very close to 1.0, when the hydrophobicity is determined in accordance with the so-called Residual Butanol Test.

SUMMARY OF THE INVENTION

The invention provides a paper which, when contacted with liquids, exhibits a reduced liquid-penetration velocity into the paper structure where the sizing effect is achieved by the presence of a hydrophobic zeolite. One advantage of the invention is the possibility to produce and size paper within a very broad pH range, thereby increasing the flexibility in the choice of pH of the fibrous suspension. Another advantage of the present invention is the short time required to obtain a full sizing effect. Furthermore, in paperboard intended for use with solid or liquid foodstuffs, tobacco or medicines, the invention reduces the problem of substances causing undesirable taste and hazardous substances. Also, the invention reduces the problem of dissolved substances present in the white water of the paper process.

The invention therefore concerns a sized paper of lignocellulose-containing fibers, which paper contains a hydrophobic zeolite. Further, the invention is directed to a method for production of sized paper by forming and dewatering a suspension of lignocellulose-containing fibers, where the dewatering is carried out in the presence of a hydrophobic zeolite.

In addition, the invention relates to the use of a hydrophobic zeolite for production of sized paper, as well as to the use of sized paper containing a hydrophobic zeolite in packaging material.

As indicated above, paper containing hydrophilic zeolites is previously known. Owing to their hydrogen-bonding nature, such zeolites are easily bound to the lignocellulose-containing fibers. According to the present invention, it has surprisingly been found possible to achieve sufficiently strong bonds between markedly hydrophobic zeolites and the lignocellulose-containing fibers to obtain a reduced liquid-penetration velocity into the paper. The sized paper and the production of said paper according to the present invention, make it possible to reduce the use and amounts of conventional sizing agents. Such conventional sizing agents can give rise to substances causing undesirable taste which have a negative effect on the content of packages for foodstuffs. The presence of retention agents increases the retention of fine fibers. The fine fibers contain a higher proportion of extractive agents, and consequently of substances causing undesirable taste, than the fibers. The presence of a hydrophobic zeolite in the paper reduces the transfer of the substances causing undesirable taste that originate from the wood and remain in the fibers and fine fibers. The presence of a hydrophobic zeolite in the paper also reduces the transfer of the substances causing undesirable taste possibly introduced by way of the paper chemicals.

Zeolites are inorganic crystalline compounds mainly consisting of $SiO_2$ and $Al_2O_3$ in tetrahedral coordination. In the present invention, zeolites also relate to other crystalline compounds of zeolite structure, such as aluminium phosphates. Such crystalline compounds of zeolite structure which can be used in the present invention are defined in W. M. Meier et. al., Atlas of zeolite structure types, sec. ed., Butterworths, London, 1987, which is hereby incorporated by reference in the present application. Many zeolites occur naturally, but most commercially used zeolites are synthetically produced. These zeolites function as adsorbents or molecular sieves and may, depending on the size of the cavities and the nature of the zeolite surface, be used to increase or decrease the taking-up of specific chemical compounds. In the present invention, an essential property of the zeolites is a limited capacity to take up water. Such a hydrophobic (water-repellent) nature also involves an increased capacity to attach non-polar compounds among which the organic substances constitute the largest group. Zeolites able to attach, inter alia, aldehydes and ketones and thus the most important substances causing undesirable taste, are primarily zeolites with a high molar ratio of $SiO_2$ to $Al_2O_3$ in tetrahedral coordination. Zeolites having such a high molar ratio can be produced by letting the synthesis take place under conditions giving a higher silicon content in the zeolite and/or by removing aluminium from the structure. Finally, the structure is stabilized by thermal treatment, whereby a decreased capacity for taking up water is obtained. In the present invention, it is important that the molar ratio of $SiO_2$ to $Al_2O_3$ in tetrahedral coordination is at least about 10:1. Suitably, the molar ratio lies in the range of from 15:1 up to 1000:1, preferably in the range of from 20:1 up to 300:1. It is especially preferred that the molar ratio of $SiO_2$ to $Al_2O_3$ in tetrahedral coordination lies in the range of from 25:1 up to 50:1.

In most zeolites, the water-repellent capacity can be modified to a certain extent by different surface treatments, such as heating in ammonia atmosphere, water vapour or air. Such surface modifications of zeolites are described in more detail in D. W. Breck, Zeolite molecular sieves: structure, chemistry, and use, John Wiley & Sons, New York, 1974, pp 507–523, and H. van Bekkum et. al., Introduction to zeolite science and practice, Elsevier, Amsterdam, 1991, pp 153–155, which are hereby incorporated by reference in the present application. The hydrophobicity of the zeolite after such treatments can be determined by the so-called Residual Butanol Test, described in GB patent specification 2,014,970. In this test, the zeolite is activated by being heated in air at 300° C. for 16 h. Then, 10 parts by weight of the thus-activated zeolite is mixed with a solution consisting of 1 part by weight of 1-butanol and 100 parts by weight of water. The resulting slurry is agitated slowly for 16 h at 25° C. Finally, the residual content of 1butanol in the solution is determined and the result given in percent by weight. A low value thus means a high degree of hydrophobicity. In the present invention, the hydrophobicity as characterized by the residual butanol content should be below about 0.5 percent by weight, suitably in the range of from 0.0002 up to 0.5 percent by weight. It is preferred that the residual butanol content lies in the range of from 0.001 up to 0.3 percent by weight. It is especially preferred that the residual butanol content lies in the range of from 0.01 up to 0.2 percent by weight.

Zeolites exhibiting a high degree of hydrophobicity, optionally after certain modification, and therefore capable of sufficiently reducing the transfer from the package to its content of substances causing undesirable taste in accordance with the present invention, are zeolites of the pentasil type, faujasite type, mordenite, erionite and zeolite L. The preparation of pentasil-type zeolites is described in U.S. Pat. Nos. specifications 3,702,886 and 4,061,724, which are hereby incorporated by reference in the present application. Suitably, the hydrophobic zeolites are of the pentasil type, since this gives a considerable reduction of the transfer of substances present which cause undesirable taste. Simultaneously, the pentasil type zeolites close to eliminate the formation of autoxidation products causing undesirable taste, e.g. when drying paper, board, or paperboard. Zeolites of the pentasil type include ZSM-5, ZSM-11, ZSM-8, ZETA-1, ZETA-3, NU-4, NU-5, ZBM-10, TRS, MB-28, Ultrazet, TsVKs, TZ-01, TZ-02 and AZ-1. Suitably, the zeolite of pentasil type is ZSM-5 or ZSM-11, preferably ZSM-5. The zeolites ZSM-5 and ZSM-11 are defined by P. A. Jacobs et. al., Synthesis of high-silica aluminosilicate zeolites, Studies in surface science and catalysis, Vol. 33, Elsevier, Amsterdam, 1987, pp 167–176, which is hereby incorporated by reference in the present application.

The amount of zeolite added may lie in the range of from about 0.05 kg/ton up to about 50 kg/ton of dry fibers and optional filler. The hydrophobic zeolite can also be used as filler, in which case the amount added may be much larger. Suitably, the amount of zeolite added lies in the range of from 0.1 kg/ton up to 25 kg/ton of dry fibers and optional filler, preferably in the range of from 0.2 kg/ton up to 10 kg/ton of dry fibers and optional filler.

To obtain a good sizing effect, the sizing agent has to be well dispersed. This may be achieved, inter alia, if the particles are small and thus penetrate the entire structure of the paper, and if the addition to the stock takes place in a position of vigorous agitation. Suitably, the zeolite has a particle size below about 20 μm, preferably lying in the range of from 0.1 μm up to 15 μm.

In papermaking, the pH in the suspension of lignocellulose-containing fibers varies within wide limits, depending on the type of fibers, the paper chemicals themselves or their requirements, the content of the white water, and so forth. In paperboard making, for instance, the pH is acid when resins are used as sizing agents, while cellulose-reactive sizing agents often are used under neutral or alkaline conditions. In the method according to the present invention, sizing may take place within a very broad pH range, since the zeolite particles are crystalline and therefore exhibit an inert nature. A good effect is thus obtained when the pH of the fibrous suspension before dewatering lies in the range of from about 3.0 up to about 10.0. Before dewatering, the suspension suitably has a pH lying in the range of from 3.5 up to 9.5, preferably in the range of from 4.0 up to 9.0.

According to the present invention, the hydrophobic zeolite is preferably introduced into the paper by addition before the head box of the papermaking machine, so-called stock sizing. The hydrophobic zeolite may be added to the stock in the form of a slurry with or without stabilizing agents, in the form of a dry powder supplied by means of a screw conveyor, or in the form of a mixture containing paper chemicals, such as retention agents and inorganic colloids. When a dispersion of conventional sizing agents, such as alkyl ketene dimers and/or alkenyl succinic anhydrides, is also added to the stock, the zeolite can be admixed to the dispersion before this is added to the stock. However, the method according to the present invention, also comprises the addition of the zeolite at previous and/or later stages of the papermaking process. Thus, the zeolite can be added as early as during the preparation of the pulp, suitably in a step at the end of the sequence for pulp production. Furthermore, in the making of paperboard, for instance, a slurry containing the zeolite may be sprayed onto one or more lignocellulcse-containing layers which layers are then couched together. Also, the zeolite can be introduced into the paper in layers not containing any lignocellulose-containing fibers. Such layers may be found between lignocellulose-containing layers or on the surface of the paper structure. Examples of the latter are coating slips.

Paper according to the present invention may contain also other paper chemicals known to be used in papermaking. Paper chemicals intended to give the paper a specific final property are called function chemicals, whereas the chemicals intended to improve production efficiency are called process chemicals. Naturally, primarily the function chemicals will form part of the finished paper, but also some process chemicals leave the process in the paper. Function chemicals include sizing agents, dry strength agents, wet strength agents, pigments, fillers, coloring agents and fluorescent whitening agents. The function chemicals may be chemically active, such as the dry strength agents and wet strength agents, or fairly inactive, such as the pigments and fillers. Fillers include calcium carbonate, such as precipitated calcium carbonate (PCC) or ground chalk, kaolin, talcum, gypsum and titanium dioxide. Process chemicals include retention agents, dewatering agents, defoamers, slime controlling agents as well as felt and wire detergents.

The water-repellent capacity of the sized paper according to the invention is improved when, in addition to the zeolite, a conventional sizing agent is included in the paper. Conventional sizing agents can be subdivided in fortified or unfortified resins, wax dispersions, sodium stearate as well as fluorine-based and cellulose-reactive sizing agents. According to the invention, it has been found particularly suitable that the finished paper contains cellulose-reactive sizing agents, since such sizing agents are covalently, and thus more strongly, bound to the cellulose fibers than the other sizing agents. The covalent bond results in a higher repellent capacity with regard to such aggressive liquids as acids, bases, lactic acid, alcohol and liquids used at high temperatures, than do resin-based sizing agents. Thus, alkyl ketene dimers (AKD) are often used to impart lactic acid resistance to liquid carton board. Other cellulose-reactive sizing agents are alkenyl succinic anhydrides (ASA), carbamoyl chloride and stearic acid anhydride. It is especially preferred to use AKD or ASA, or combinations thereof.

The amount of conventional sizing agent added may lie in the range of from about 0.1 kg/ton up to about 15 kg/ton, calculated as active substance and based on dry fibers and optional filler. Suitably, this amount lies in the range of from 0.2 kg/ton up to 10 kg/ton, based on dry fibers and optional filler. The ratio of hydrophobic zeolite to conventional sizing agent may lie in the range of from about 0.003 up to about 500, suitably in the range of from 0.01 up to 250, and preferably in the range of from 0.02 up to 50.

When conventional sizing agents are used together with a hydrophobic zeolite, the order of addition is optional. The liquid-penetration velocity does, however, become lower if the zeolite is added before the conventional sizing agent. A good sizing effect is also obtained if the conventional sizing agent and zeolite are mixed before being added to the fibrous suspension.

To increase the yield of the addition of zeolite, forming and dewatering suitably take place in the presence of a retention agent. Such retention agents are previously known in papermaking. Suitable compounds include polysaccharides, such as starch, cellulose derivatives and guar gum, or synthetically prepared homopolymers, such as polyacryl amide (PAM), polyamide amine (PAA), polydiallyl dimethyl ammonium chloride (poly-DADMAC), polyethylene imine (PEI) and polyethylene oxide (PEO), or copolymers thereof. The cationic and anionic nature of the retention agents are enhanced by the introduction of nitrogen-containing groups or covalently bound phosphor groups, respectively. Methods for the introduction of such groups are well-known to the expert. In the method according to the present invention, it has been found especially suitable to use cationic retention agents, such as starch, PAM and PEI, or combinations thereof, since this results, inter alia, in a high retention.

The amount of retention agent added may lie in the range of from about 0.01 kg/ton up to about 20 kg/ton, based on dry fibers and optional filler. Suitably, this amount lies in the range of from 0.02 kg/ton up to 10 kg/ton, based on dry fibers and optional filler.

When a retention agent is used together witch a hydrophobic zeolite, the order of addition is optional. However, the sizing effect is enhanced if the zeolite is added before the retention agent, which increases the proportion of zeolite that remains in the-paper structure and, consequently, the hydrophobic nature of the finished paper. A good sizing effect is also obtained if the retention agent and zeolite are mixed before being added to the fibrous suspension.

In the production of sized paper according to the invention, retention and dewatering can be enhanced by the presence of anionic inorganic colloids which have been used previously in papermaking. The colloids are added in the form of dispersions (sols) which do not settle due to the large ratio of surface to volume. Suitably, these colloidal inorganic particles have a specific surface area exceeding about 50 $m^2/g$. Such inorganic colloids include bentonite, montmorillonite, titanyl sulphate sols, aluminium oxide sols, silica sols, aluminium-modified silica sols and aluminium silicate sols. Suitably, the inorganic colloids used are silica-based sols. Especially suitable silica-based sols are the aluminium-containing silica sols described in European patent 185,068, which is hereby incorporated by reference in the present application. Preferably, the silica-based sols have at least one surface layer containing aluminium, whereby the sols become resistant within the whole pH range that can be used in the method according to the present invention.

Suitably, the colloidal silica particles have a specific surface lying in the range of from about 50 $m^2/g$ up to about 1000 $m^2/g$, as well as a particle size lying in the range of from about 1 nm up to about 20 nm. Silica-based sols meeting the above specifications are commercially available, e.g. from Eka Nobel AB in Sweden.

Suitable sols may also be based on polysilicic acid, which means that the silicic acid is in the form of very small particles (in the order of 1 nm) having a very large specific surface (at least exceeding 1000 $m^2/g$ and ranging up to 1700 $m^2/g$) and involving a certain formation of microgel. Sols of this type are disclosed in Australian patent 598,416.

In the production of sized paper according to the invention, dewatering may also take place in the presence of cationic inorganic colloids which have been used previously in papermaking. Such colloids can be prepared from commercial sols of colloidal silica or from silica sols consisting of polymeric silicic acid prepared by acidification of alkali metal silicates. Such colloids are described in PCT application WO 89/00062, which is hereby incorporated by reference in the present application.

The amount of anionic or cationic inorganic colloid added may lie in the range of from about 0.05 kg/ton up to about 30 kg/ton, based on dry fibers and optional filler. Suitably, this amount lies in the range of from 0.1 kg/ton up to 15 kg/ton, based on dry fibers and optional filler.

If, in addition to a retention agent, an anionic or cationic inorganic colloid is added to the fibrous suspension, the zeolite is suitably added before both the retention agent and colloid. Preferably, the zeolite is added first, followed by the retention agent and then the colloid, thereby considerably improving the dewatering and retention.

In four-component systems, the order of addition is preferably as follows: zeolite, conventional sizing agent, retention agent and inorganic colloid.

In the production of sized paper according to the invention, retention and dewatering may be further enhanced by the presence of one or more aluminium compounds which are previously known in papermaking. By improving the dewatering effect, the speed of the papermaking machine can be increased and the necessary drying capacity can be reduced. Suitable aluminium compounds in the present invention are such compounds that can be hydrolyzed to cationic aluminium hydroxide complexes in the fibrous suspension. The improved retention and dewatering are then achieved by the interaction with anionic groups on the fibers and of other paper chemicals. The capacity of various aluminium compounds to be hydrolyzed to such cationic complexes is primarily a function of the pH of the fibrous suspension. In fibrous suspensions which, before addition, have a pH lying in the range of from about 3.5 up to about 7, it is especially suitable to use aluminates, such as sodium aluminate or potassium aluminate. In fibrous suspensions which, before addition, have a pH lying in the range of from about 6 up to about 10, especially suitable aluminium compounds include alum, aluminium chloride, aluminium nitrate and polyaluminium compounds. The polyaluminium compounds have an especially strong and stable cationic charge in this higher pH range. Thus, preferably a polyaluminium compound is used as aluminium compound under neutral or alkaline conditions.

Suitable compounds include polyaluminium compounds of the general formula $$Al_n(OH)_mX_{3n-m} \quad (I)$$

wherein

X is a negative ion, such as $Cl^-$, $\frac{1}{2}$ $SO_4^{2-}$, $NO_3^-$ or $CH_3COO^-$ and n and m are positive integers, such that 3n−m is greater than 0.

Preferably, $X=Cl^-$. Such polyaluminium compounds are known as polyaluminium chlorides (PAC).

Ekoflock, produced and marketed by Eka Nobel AB in Sweden, is one example of a commercially available polyaluminium compound.

The charge of the cationic complexes is not only influenced by the pH of the fibrous suspension, but also by the time elapsing from the addition of the aluminium compounds to the forming and dewatering. As the time increases, the charge intensity decreases, thereby reducing the retention of the fine fraction and the paper chemicals and, to a lesser extent, the dewatering. Thus, the residence time for the aluminium compound in the fibrous suspension is suitably below about 5 min from the addition to forming and dewatering of the suspension.

The amount of aluminium compound added may be below about 5 kg/ton, recalculated as $Al_2O_3$ and based on dry fibers and optional filler. Suitably, the amount of aluminium compound lies in the range of from 0.01 kg/ton up to 2 kg/ton, recalculated as $Al_2O_3$ and based on dry fibers and optional filler.

Apart from a sizing effect on the paper, the zeolite added has a purifying effect on the recirculating water (white water) employed to suspend the lignocellulose-containing fibers and paper chemicals. In this context, the time for adding the zeolite essentially decides which effect will dominate. The longer the hydrophobic zeolite stays in the suspension of lignocellulose-containing fibers and optional paper chemicals, the larger the amount of dissolved chemical substances adsorbed on the surface of the zeolite particles. Since the zeolite particles are absorbed in the paper structure, the concentration of undesirable material in the white water will decrease. To obtain a good sizing effect according to the invention, the zeolite is suitably added less than about 20 min before forming and dewatering the suspension of lignocellulose-containing fibers. Preferably, the zeolite is added less than 5 min before forming and dewatering the suspension. Furthermore, the zeolite is suitably added in the machine chest or in the pipe system running from said chest towards the head box in connection with pumping, deaeration or screening. Preferably, the zeolite is added immediately before the head box of the papermaking machine, e.g. at the fan pump in which white water is mixed with stock before the resulting mixture is forwarded to the head box.

According to the present invention, a hydrophobic zeolite is suitably used for making sized paper. The hydrophobic zeolite is suitably of the pentasil type, preferably ZSM-5. Suitably, the sized paper is paperboard for solid or liquid foodstuffs, fine paper or kraft liner. Suitably, the sized paper containing a hydrophobic zeolite is used in packaging material. The packaging material comprises one or more layers of paper, board, paperboard or plastic, or combinations thereof, intended to contain solid or liquid foodstuffs, medicines or tobacco. Preferably, the sized paper containing a hydrophobic zeolite is used in packaging material of paperboard, optionally coated with one or more plastic layers and intended to contain liquid foodstuffs, such as a milk or juice.

Also, the present invention is advantageously used for producing fine paper. In the production of these grades, the degree of sizing is an important property to control the penetration of liquid in subsequent coating operations and size press applications of starch. Normally, cellulose-reactive sizing agents are employed in these operations and applications. One disadvantage of sizing agents of this type is that they have too long a reaction time to give sufficient sizing before the size press and/or coating unit. Adding zeolite to the stock results in an instantaneous sizing effect, thus improving the control of the penetration of liquid. Also, hydrophobic zeolites are advantageously employed for improving the opacity of certain paper grades. Opacity or non-transparency means a capacity of visually hiding black print on underlying paper or on the opposite side of the same paper. Paper grades with high opacity requirements include fine paper, improved newsprint paper and magazine paper.

The invention is advantageously used also in the making of kraft liner, which is a kraft paper made from 100% high-yield sulphate pulp. By using zeolite as sizing agent, the contents of dissolved material in the white water can be considerably reduced, such that also cellulose-reactive sizing agents may be employed.

In the present invention, paper relates to web- or sheet-shaped products of randomly distributed lignocellulose-containing fibers, which may also contain chemically active or fairly passive paper chemicals. In the present invention, paper relates to paper, board, paperboard and pulp. In this connection paper and board relates to web- or sheet-shaped products having grammages below and above, respectively, about 225 g/m$^2$. Paperboard is a flexurally rigid paper or thin board consisting of one or more layers of lignocellulose-containing fibers which have been pressed together under wet conditions. The paperboard layers may consist of similar fibers or, which is more common, of low-quality fibers in the inner layers and high-quality fibers in the surface layers. Low-quality fibers here relate to mechanically produced fibers or recycled fibers, whereas high-quality fibers relate to chemically produced fibers. In liquid carton board, for instance, it is common with a central layer of chemi-thermomechanical pulp (CTMP), whereas the top and bottom layers consist of bleached or unbleached sulphate pulp. Web-dried pulps in the form of sheets or webs and flash-dried pulps are, after slushing, intended for later production of paper, board or paperboard. Suitably, the sized paper according to the present invention is paper, board, paperboard or pulp having a grammage below about 700 g/m$^2$, preferably in the range of from 35 g/m$^2$ up to 500 g/m$^2$. The invention does not concern fluff pulp intended for dry shredding into fluff, which is a product consisting of unbound pulp fibers and fiber flocks.

Lignocellulose-containing fibers relate to fibers of hardwood and/or softwood which have been separated by chemical and/or mechanical treatment, or recycled fibers. Examples of chemical treatment is digestion according to the sulphate, sulphite, soda or organosolv process. Examples of mechanical treatment are the refining of chips in a disc refiner and the grinding of logs in a pulp grinder, resulting in refiner mechanical pulp (RMP) and stone groundwood pulp (SGW), respectively. Pre-impregnation of chips with chemicals and/or refining at a raised temperature results in thermomechanical pulp (TMP), chemimechanical pulp (CMP) or chemi-thermomechanical pulp (CTMP). In mechanical treatment under pressure in pulp grinders, pressure groundwood pulp (PGW) is obtained. The fibers may also be separated by modifications of the above chemical and mechanical processes. Suitably, the fibers are separated by mechanical treatment or are recycled fibers. It is especially suitable to employ virgin fibers separated by mechanical treatment, and especially preferred to employ fibers separated in a disc refiner.

The invention and its advantages will be illustrated in more detail by the following Examples which, however, are only intended to illustrate the invention without limiting the same. The parts and percentages stated in the description, claims and Examples, relate to parts by weight and percent by weight, respectively, unless otherwise stated.

The hydrophobic zeolite used in the Examples is of the ZSM-5 type, produced by Eka Nobel AB. The molar ratio of $SiO_2$ to $Al_2O_3$ in tetrahedral coordination is 32, and the residual butanol content is 0.14% by weight.

The conventional sizing agent used in the Examples is alkyl ketene dimers (AKD), with a content of alkyl ketene dimers of 14% and with a dry content of 18.8%. Example 1 also shows two tests with a type of AKD in which the content of alkyl ketene dimers is 21.6% and the dry content is 28%.

The retention agent used in the Examples is a cationic starch with a content of nitrogen-containing groups of 0.35% and with a dry content of 84.9%.

The anionic inorganic colloid used in the Examples is a silica-based sol marketed by Eka Nobel AB under the trade name of BMA-0 and having a specific surface of 500 m$^2$/g and an average particle size of 5 nm.

In the Examples, the sizing effect on the paper was determined by measuring the edge penetration according to the Wick index method and by the Cobb method, both being standardized methods for determining liquid penetration of paper. In the Wick index method, the edge is dipped in a 30% hydrogen peroxide solution for a standardized period of time, whereupon the increase in weight is recorded. In the Cobb method, a water column of standardized height and bottom area is placed on the paper for 45 s, whereupon the increase in weight is recorded. Thus, low values according to the Cobb method as well as the Wick index method mean a lower liquid-penetration velocity.

The ash content has been used as a measure of the degree of retention of the zeolite. The ash content was determined by combustion at 900° C. for 90 min, whereupon the remainder was weighed.

EXAMPLE 1

Table I shows the results of sizing tests in which 1.5 kg/ton of pulp of a hydrophobic zeolite was added to a fibrous suspension containing fibers from a CTMP pulp of softwood. The pulp concentration was 0.5% by weight, and the pH of the fibrous suspension was adjusted to 7.1 by means of $H_2SO_4$. After the zeolite, 1 or 3 kg of alkyl ketene dimers/ton of pulp was added in the form of a 0.5% solution. Then, 8 kg of cationic starch/ton of pulp was added in the form of a 2.0% solution, followed by 2 kg of anionic silica-based sol/ton of pulp, in the form of a 1.0% solution. Sheets of paper having a grammage of 150 g/m$^2$ were prepared in a Finnish sheet mould, whereupon they were blotted and pressed. The sheets were dried on a rotating drum at 105° C. for 5 min and hardened at 120° C. for 15 min. For control purposes, a test was also carried out without zeolite and alkyl ketene dimers (Test 1). Furthermore, the alkyl ketene dimers used in Tests 1–6 have been replaced with alkyl ketene dimers of a higher dry content in Tests 7 and 8. In Test 9, 1.5 kg of alum/ton of dry pulp was added before the zeolite. Here, the pH was adjusted by means of bicarbonate, whereupon 4 kg of starch and 1 kg of silica-based sol/ton of pulp were added, i.e. half the amount added in Tests 1–8.

TABLE I

| Test No. | AKD kg/ton | Zeolite kg/ton | $Cobb_{60}$ | Wick index kg/m$^2$ | Ash content % |
|---|---|---|---|---|---|
| 1 | 0 | 0 | — | 12.3 | 1.5 |
| 2 | 0 | 1.5 | — | 10.4 | 1.6 |
| 3 | 1 | 0 | — | 10.6 | 1.4 |
| 4 | 1 | 1.5 | — | 10.0 | 1.6 |
| 5 | 3 | 0 | 29.9 | 8.2 | 1.5 |
| 6 | 3 | 1.5 | 25.8 | 6.1 | 1.5 |
| 7 | 3 | 0 | 40.1 | 10.0 | 1.3 |
| 8 | 3 | 1.5 | 29.8 | 7.8 | 1.6 |
| 9 | 3 | 1.5 | 24.5 | 7.3 | 1.8 |

As is apparent from the Table, the edge penetration is reduced when a hydrophobic zeolite forms part of the finished paper.

EXAMPLE 2

Table II shows the results of sizing tests in which 1.5 or 8 kg/ton of pulp of a hydrophobic zeolite was added to a fibrous suspension of a CTMP pulp. The pulp concentration was 0.5% by weight, and the pH of the fibrous suspension was adjusted to 7.5 by means of an acid. 5 s after the addition of zeolite, 1, 3 or 5 kg of alkyl ketene dimers/ton of pulp was added in the form of a 1% solution. Another 10 s later, 8 kg of starch/ton of pulp was added in the form of a 0.5% solution. 30 s thereafter, 2 kg of silica-based sol/ton of pulp was added, also in the form of a 0.5% solution. After another 15 s, sheets of paper with a grammage of 150 g/m$^2$ were produced in a dynamic (French) sheet mould, whereupon they were dried in a climatic chamber over night and hardened at 120° C. for 12 min. For control purposes, a test was also carried out without zeolite and alkyl ketene dimers (Test 1). In addition, tests were carried out where the zeolite was added 5 min before the alkyl ketene dimers (Test 9) and where the alkyl ketene dimers were added 5 min before the zeolite (Test 10).

TABLE II

| Test No. | Zeolite kg/ton | AKD kg/ton | Wick index kq/m$^2$ | Ash content % |
|---|---|---|---|---|
| 1 | 0 | 0 | infinite | 0.7 |
| 2 | 0 | 1 | 10.8 | 0.7 |
| 3 | 0 | 5 | 3.3 | 0.7 |
| 4 | 1.5 | 1 | 8.4 | 0.8 |
| 5 | 1.5 | 5 | 3.2 | 0.8 |
| 6 | 8.0 | 1 | 6.7 | 1.3 |
| 7 | 8.0 | 3 | 2.7 | 1.4 |
| 8 | 8.0 | 5 | 2.6 | 1.3 |
| 9 | 1.5 | 3 | 2.9 | 0.8 |
| 10 | 1.5 | 3 | 3.4 | 0.7 |

As is apparent from the Table, the edge penetration decreases as the content of hydrophobic zeolite increases. A comparison between Test 9 and Test 10 shows that a better sizing effect is obtained when the zeolite is added before the alkyl ketene dimers than with the opposite order of addition.

We claim:

1. A sized paper of lignocellulose-containing fibers, including a hydrophobic zeolite, wherein the hydrophobicity of the zeolite characterized by the residual butanol content is below about 0.5 percent by weight.

2. A sized paper according to claim 1, wherein the hydrophobicity of the zeolite is from 0.001 up to 0.3 percent by weight.

3. A sized paper according to claim 1, wherein the zeolite has a molar ratio of $SiO_2$ to $Al_2O_3$ in tetrahedral coordination of at least about 10:1.

4. A sized paper according to claim 1, wherein the zeolite is a pentasil type.

5. A sized paper according to claim 1, wherein the amount of zeolite is from about 0.05 kg/ton up to about 50 kg/ton of dry fibers and filler.

6. A sized paper according to claim 1, wherein the paper contains a conventional sizing agent.

7. A sized paper according to claim 1, wherein the lignocellulose-containing fibers are recycled fibers or fibers which have been separated mechanically.

8. A method for production of sized paper, comprising forming and dewatering a suspension of lignocellulose-containing fibers, wherein the dewatering is carried out in the presence of a hydrophobic zeolite, and wherein the hydrophobicity of the zeolite characterized by the residual butanol content is below about 0.5 percent by weight.

9. A method according to claim 8, wherein the hydrophobicity of the zeolite is from 0.001 up to 0.3 percent by weight.

10. A method according to claim 8, wherein the zeolite has a molar ratio of $SiO_2$ to $Al_2O_3$ in tetrahedral coordination of at least about 10:1.

11. A method according to claim 8, wherein the amount of zeolite added is from about 0.05 kg/ton up to about 50 kg/ton of dry fibers and filler.

12. A method according to claim 8, wherein the dewatering is carried out in the presence of a conventional sizing agent.

13. A method according to claim 12, wherein the conventional sizing agent is an alkyl ketene dimer (AKD), an alkenyl succinic anhydride (ASA) or combinations thereof.

14. Method according to claim 12, wherein the zeolite is added in the form of a dispersion containing a conventional sizing agent.

15. A method according to claim 12, wherein the zeolite is added before the conventional sizing agent.

16. A method according to claim 8, wherein the zeolite is added immediately before the head box of the papermaking machine.

17. A method for rendering sized paper hydrophobic, comprising incorporating in the paper a hydrophobic zeolite, wherein the hydrophobicity of the zeolite characterized by the residual butanol content is below about 0.5 percent by weight.

18. A method for producing hydrophobic packaging material, comprising incorporating in sized paper a zeolite, wherein the hydrophobicity of the zeolite characterized by the residual butanol content is below about 0.5 percent by weight, and forming said packaging material from the sized paper.

* * * * *